United States Patent [19]

Mackenzie et al.

[11] 4,099,473

[45] Jul. 11, 1978

[54] FUEL HANDLING, METERING AND PREPARATION APPARATUS AND METHOD

[75] Inventors: Harold B. Mackenzie, Wheaton, Ill.; Ingvar G. Anderson, Dunedin, Fla.

[73] Assignee: New Life Foundation, Wheaton, Ill.

[21] Appl. No.: 721,163

[22] Filed: Sep. 7, 1976

Related U.S. Application Data

[63] Continuation-in-part of Ser. No. 619,056, Oct. 2, 1975, abandoned.

[51] Int. Cl.[2] ..... F23G 5/02; F23K 3/00

[52] U.S. Cl. ..... 110/219; 110/222; 110/255; 110/346; 241/DIG. 38; 241/186 A

[58] Field of Search ..... 214/17 D; 241/186 R, 241/186 A, 186.2, 186.4, DIG. 38; 222/199, 200; 110/8 R, 8 P, 7 R, 15, 101 R, 106

[56] References Cited

U.S. PATENT DOCUMENTS

| | | | |
|---|---|---|---|
| 2,213,668 | 9/1940 | Dundas et al. | 110/15 |
| 2,732,138 | 1/1956 | Forth | 241/186.4 |
| 2,756,972 | 7/1956 | Stokes et al. | 214/17 D |
| 2,851,173 | 9/1958 | Morrison | 214/17 D |
| 2,907,498 | 10/1959 | Lely et al. | 222/200 |
| 3,103,301 | 9/1963 | Pierson | 214/17 D |
| 3,387,574 | 6/1968 | Mullen | 110/7 |
| 3,412,699 | 11/1968 | Culp et al. | 110/101 |
| 3,818,846 | 6/1974 | Reese | 110/8 |
| 3,926,302 | 12/1975 | Smith | 214/17 D |

*Primary Examiner*—Kenneth W. Sprague
*Attorney, Agent, or Firm*—Hill, Gross, Simpson, Van Santen, Steadman, Chiara & Simpson

[57] ABSTRACT

A bin receives coarse discrete primary shredded fuel material, such as may be derived from municipal refuse, and metering conveyor means move the material from the bin through efficient discharge controlling means to smooth flow conveyor means which deliver the fuel material to means for further preparation, e.g. a reshredder. Thence, the reshredded fuel, which may be preheated, is adapted to be conducted in a suspended, aerated state non-stop into the combustion zone of combustion means such as a boiler or a cement kiln.

39 Claims, 14 Drawing Figures

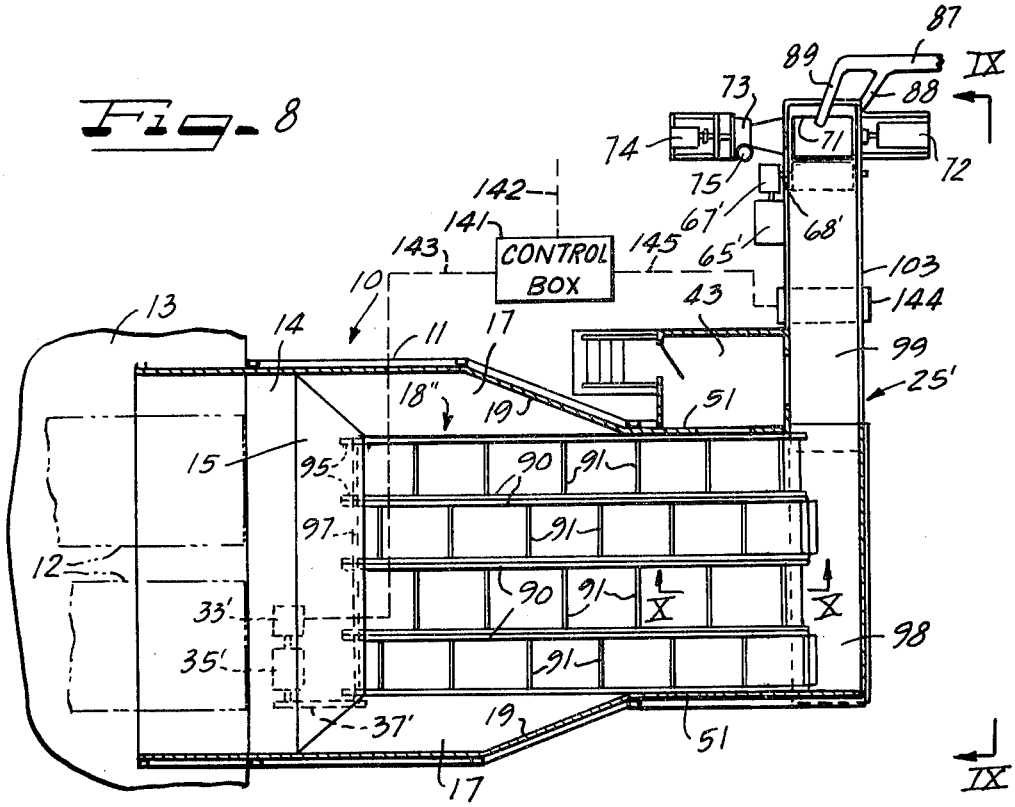
Fig. 8
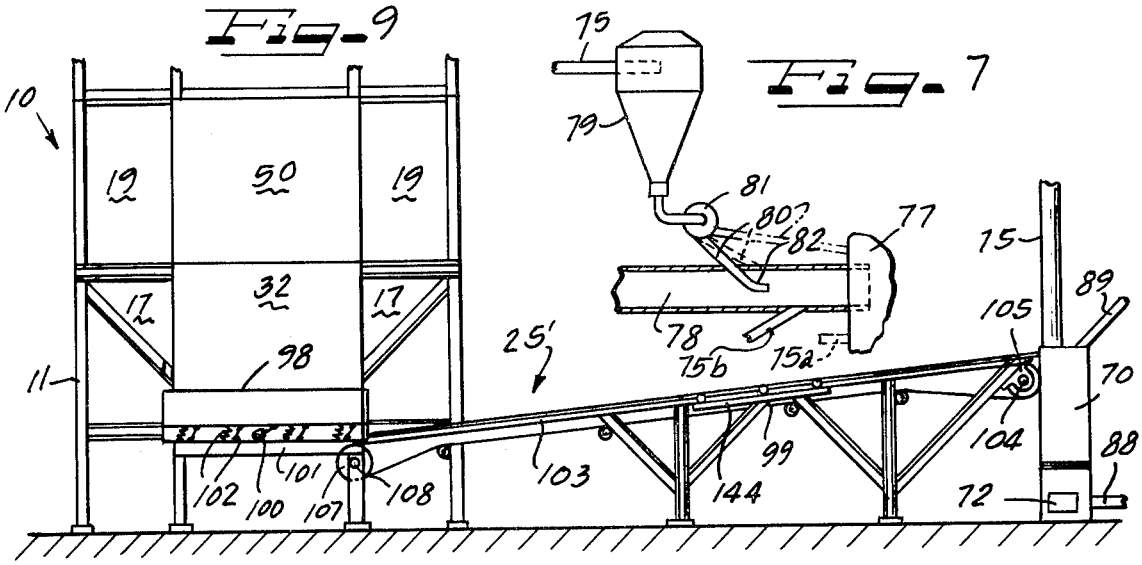
Fig. 9
Fig. 7
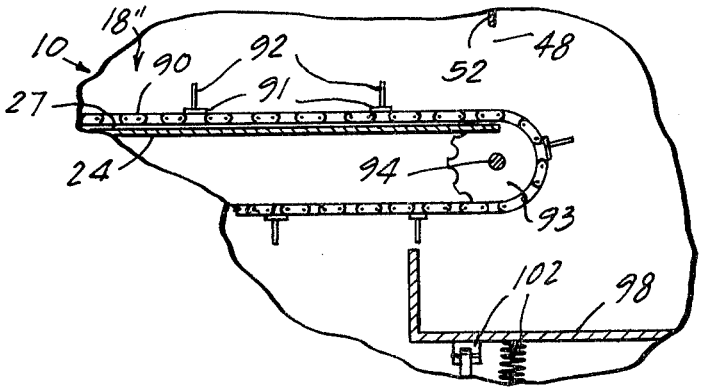
Fig. 10

FUEL HANDLING, METERING AND PREPARATION APPARATUS AND METHOD

The present application is a continuation-in-part of our copending application Ser. No. 619,056, filed Oct. 2, 1975, now abandoned.

This invention relates to the handling of discrete shredded fuel material in a more or less flocculent state, such as combustible fractions recovered from municipal waste.

A modern trend is to shred and classify municipal waste to recover useful materials therefrom. An important fraction of such waste comprises combustible materials, including paper, plastic, cardboard, rags, wood, grass, leaves and the like. These recovered materials, properly graded and processed, provide advantageous, economical fuel for various industrial purposes such as in the boilers which generate steam for electric utilities, cement-making kilns, and the like. After primary shredding and separation, the recovered combustible discrete waste materials are of generally a more or less flocculent, bulk consistency, tending to flow unevenly, to wad, mat, or form clumps and in general to resist free-flowing, in contrast to granular materials. On the other hand, fuel flow requirements for industrial boilers or kilns are often fairly critical, sometimes fluctuating, but at all times necessitating maintaining continuous optimum uniform temperature values, depending upon the amount of heat required. For example, in a typical utility boiler or cement kiln installation, fuel requirements may fluctuate from zero to fifty tons per hour in the combustion zone, and regardless of such peak and valley demands the fuel must be delivered uniformly to maintain satisfactory combustion performance.

It is therefore an important object of the present invention to provide a new and improved fuel handling, metering and processing apparatus and method especially suitable for handling discrete fuel materials such as may be recovered from municipal waste.

Another object of the invention is to provide new and improved fuel metering apparatus and method especially adapted for handling large volumes of discrete, shredded fuel materials.

According to features of the invention, fuel handling, metering and preparation apparatus comprises a bin for receiving bulk discrete primary shredded fuel material, especially such as may be derived from municipal waste, metering conveyor means being provided for moving the discrete fuel material to discharge from the bin, means cooperating with the metering conveyor means for efficiently controlling and promoting uniformity of metered discharge from the bin, and means for receiving the fuel material at discharge from the bin and effecting substantially smooth, uniform flow conveyance of the fuel to means for further preparation of the fuel for delivery to combustion means.

According to other features of the invention, a secondary shredder may receive the primary shredded fuel material from the delivery conveyor means and a blower may receive the reshredded fuel. In the secondary shredder and/or adjacent thereto the fuel material may be preheated to enhance combustibility. A duct may receive the reshredded fuel from the blower for conveying the fuel non-stop and in substantially freely discrete particulate suspended condition into the combustion zone of combustion means. Conveying of the material in preheated air maintains the material in preheated condition while being conveyed, and avoids temperature drop in, and maintains uniformity of temperature in, combustion means to which the suspended fuel is delivered.

A method according to the present invention comprises receiving discrete primary shredded fuel material in a bin, metering the fuel material from the bin, acting on the shredded fuel material in the bin to control and promote uniformity of metered discharge from the bin, conveying metered material in substantially smooth, uniform flow to means for further preparation of the fuel material for delivery to combustion means. Reshredding of the material may be effected before delivery to the combustion means. Improved discrete particle separation and suspended aeration may be effected by blowing the reshredded fuel material non-stop through a duct into the combustion means. Preheating of the fuel material may be effected while the material is in continuous movement while undergoing reshredding and/or immediately thereafter for enhancing its combustibility and the efficiency of the combustion means. Preheating air may be conveniently derived from the combustion means to which the fuel material is to be delivered.

Other objects, features and advantages of the invention will be readily apparent from the following description of certain representative embodiments thereof, taken in conjunction with the accompanying drawings, although variations and modifications may be effected without departing from the spirit and scope of the novel concepts embodied in the disclosure, and in which:

FIG. 7 is a schematic view illustrating delivery of the fuel to a pulverized coal delivery conduit of a boiler or kiln;

FIG. 8 is a top plan sectional view similar to FIG. 2 but showing a modification;

FIG. 9 is an enlarged elevation taken substantially in the plane of line IX—IX in FIG. 8;

FIG. 10 is an enlarged sectional detail view taken substantially along the line X—X in FIG. 8;

Figure 1:
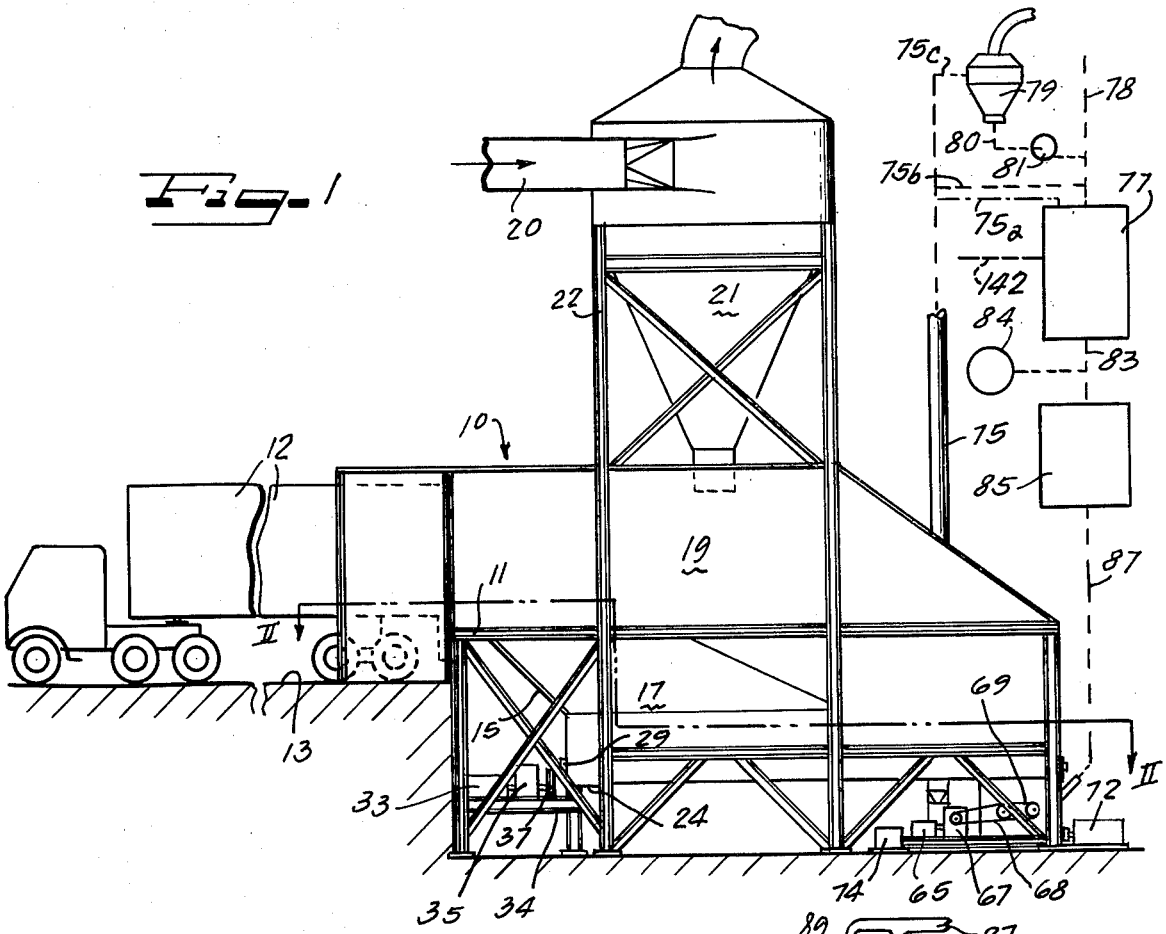
FIG. 1 is a schematic elevational view of apparatus embodying features of the invention.

According to the present invention, a large volume bin structure 10 is provided to receive discrete fuel material such as is advantageously obtained by sorting primary shredded combustibles from municipal rubbish. Such material may include any or all of paper, newspapers, plastic film, cardboard, paperboard containers, heavier plastic such as derived from containers, rags, grass, leaves, wood, and the like, and may be classified, i.e. sorted for the particular use to which the fuel is to be put. For example, all of the materials mentioned may be included in a heavier grade of fuel for use in stoker-coal boilers. A lighter grade of fuel will comprise almost entirely paper and film plastic, for use in pulverized-coal boilers, and in cement making where the fuel is injected into the kiln and the ash is incorporated into the cement product. In a desirable construction, the bin 10 comprises a supporting framework 11 which may be permanently mounted on a supporting base, but may be constructed and arranged for portability so that it can be readily transported to and erected for selective onsite use. Where the bin is to be supplied from conveyances such as trucks 12 (FIGS. 1, 2 and 3) an elevated dumping ramp 13 may be provided, so that the trucks can be backed up to a threshold platform 14 at the upper receiving end of the bin 10. Raw shredded material from the conveyances 12 is dumped over the threshold platform 14 to descend down an inclined bin wall 15 between convergently sloping substantially spaced apart bin side walls 17 onto a metering conveyor 18 in the bottom of the bin. Upstanding side walls 19 substantially increase the volumetric capacity of the bin.

If the apparatus is located adjacent to or in association with a waste sorting and classifying installation, waste fuel material may be delivered directly to the bin 10 as by means of a duct 20 delivering to a hopper 21, such as of the cyclone type, supported by a tower structure 22 on the frame 11 in position to discharge downwardly between the walls 19 onto the conveyor 18.

Figure 5:
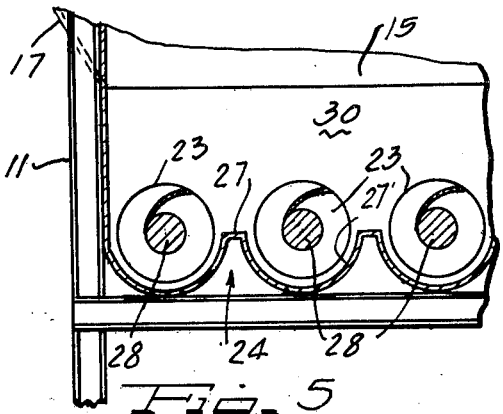
FIG. 5 is a fragmentary enlarged sectional elevational view taken substantially along the line V—V of FIG. 2 but showing a slightly modified bottom wall structure.

Fuel requirements for the combustion means to be supplied with fuel from the bin 10 must be uniformly met in spite of variable fuel demand. Even though the fuel material supplied from the bin 10 is of a discrete, shredded and generally flocculent nature, and thus not easily mechanically transferable from a large static storage mass to a point of use, the present apparatus accomplishes such transfer with metered, substantially uniformly smooth, free-flowing optimum efficiency. To this end, the metering conveyor means 18 moves primary shredded fuel material from the bottom of the stored mass within the bin 10 at a metered flow rate corresponding to combustion demand. In one preferred form, the metering conveyor means 18 comprises a plurality of parallel conveyor screws 23 (FIGS. 2, 3 and 5) extending from the bottom of the rear end wall 15 and throughout the extent of a bin bottom wall 24, the front end of such bottom wall being at a discharge end from which the material is received and conveyed in substantially uniform, smooth flow by means comprising a transversely extending delivery conveyor device 25.

The bottom wall 24 may have a flat surface 27 with the conveyor feed screws 23 suitably adjacently spaced thereabove and from each other to avoid jamming from an unyielding object that may inadvertently fall into the bin 10 and to facilitate better control of fuel movement. If preferred, the bottom wall 24 may comprise the structure shown in FIG. 5 wherein the surface 27 has respective troughs 27' of a depth about half the diameter of the conveyor feed screws 23, with the surfaces defining the troughs 27' suitably spaced from the edges of the helical flights of the screws 23.

In the present instance, eight of the helical conveyor screws 23 are mounted in substantially uniformly spaced relation along the bottom wall 24, the spacing between the perimeters of the screws 23 being preferably less than the radius dimension of the screws. The screws 23 are concurrently rotatable to advance material from within the bin 10 along the bottom wall 24 toward the delivery conveyor 25. This assures uniform metered feedout of fuel material from the bottom of the mass in the bin. Means for mounting the conveyor screws 23 comprise respective shafts 28 which are journaled at the rear of the bin 10 as by means of bearings 29 (FIGS. 1 and 3) carried by a vertical downward wall extension portion 30 (FIGS. 3 and 5) below the lower end of the sloping wall 15. At their front ends, the shafts 28 are journaled in bearings 31 carried by a vertical front retainer wall 32 along the front or outer end of the bin 10. Means for driving the screws 23 in unison comprise a variable-speed drive and controller including a motor 33 mounted on a platform 34 under the rear wall 15 and acting through a gear box 35 and a coupling transmission 37 to drive the screw shafts 28. It may be noted that in order to maintain thorough metering control, the conveyor 18 is substantially horizontal, so that material advanced and discharged from the bin 10 will remain substantially free from free-flowing gravitational flow but will be under metered flow control at the discharge end of the bin.

Figure 6:
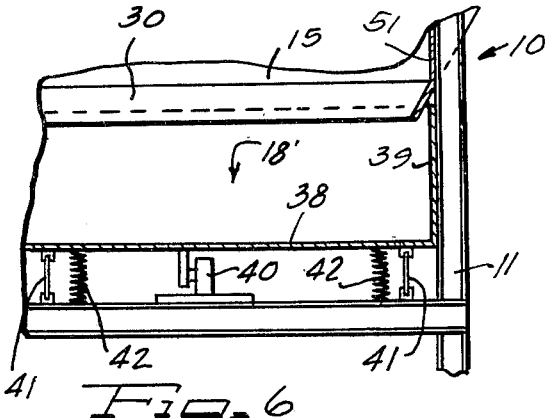
FIG. 6 is a view similar to FIG. 5 but showing another modification.
Figure 11:
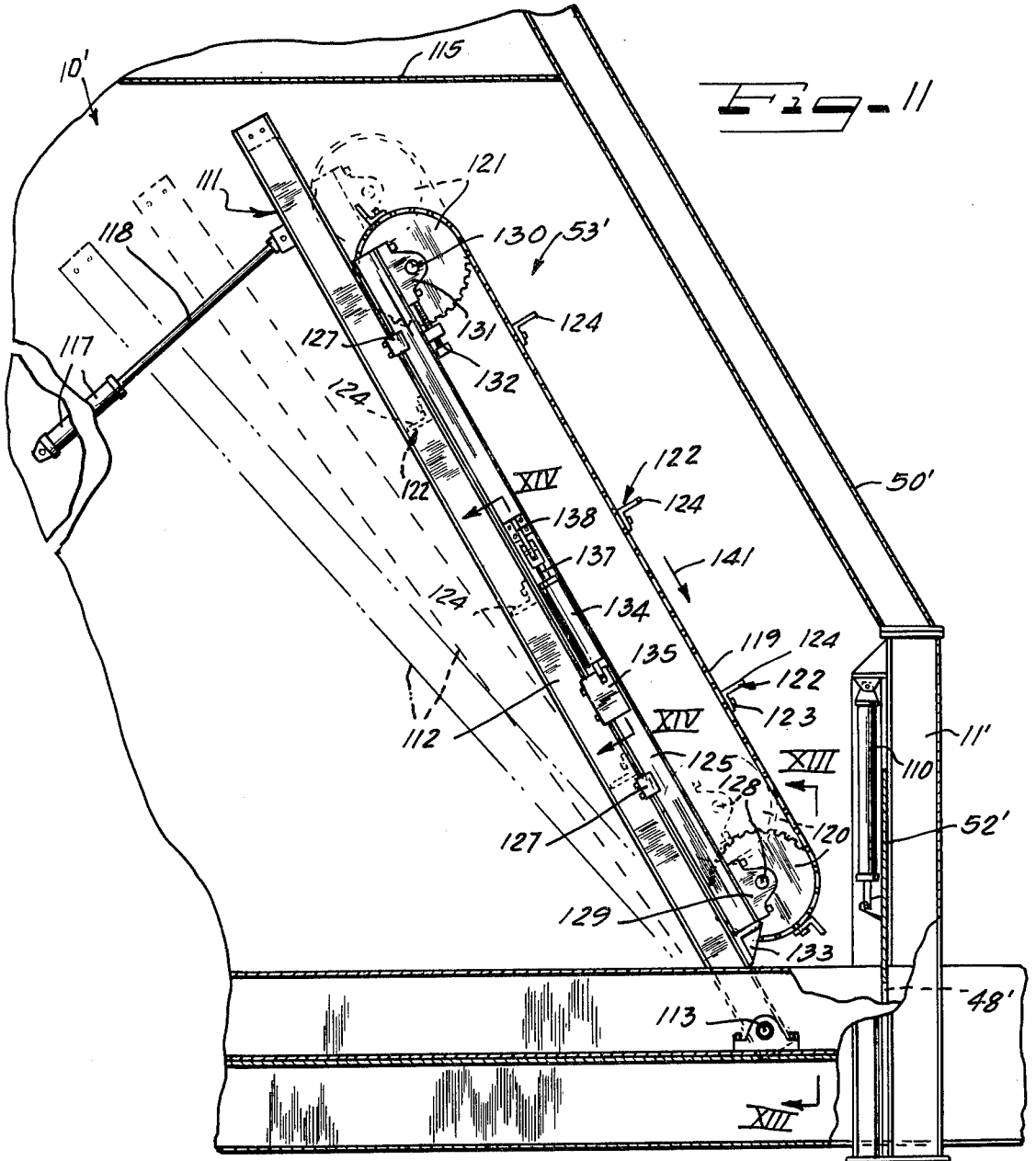
FIG. 11 is a fragmental sectional elevational detail view showing a modification of the device for improving the metered discharge of fuel material from the fuel bin.

If preferred, instead of screw conveyor means, the bin bottom metering conveyor may comprise a horizontally vibrating conveyor 18' (FIG. 6) in the form of a flat plate 38 having upturned curb flanges 39 comprising side walls along its front to rear longitudinal edges and a rear wall along its rear edge, and underlying the sloping rear wall 15 and the converging side walls 17. In this instance, the conveyor plate 38 itself may provide the bottom of the bin 10 and may be driven by a suitable actuator 40 with variable-speed drive to provide the feed rate required. Suitable linkage means 41 and spring means 42 may be provided to support and provide for the vibrating reciprocating shaking action of the conveyor 38.

An observation and control station for the metering conveyor system of the apparatus comprises an observation platform 43 at a suitable location such as in the angle between the conveyors 18 and 25 accessible by a stairway 44 and enclosed within a cabin 45 having observation pots or windows 47 for observation of the conveyors. Within the cabin 45 may also be housed automatic and/or manual controls for correlating operation of the conveyor system and related apparatus with fuel demand, and other regulating and adjusting functions such as temperature controls where that is a desirable feature in operation of the apparatus.

A second stage metering of the discrete fluid material from the bin 10 is attained by means of a metering discharge gate 48 (FIGS. 2 and 3) at the discharge end of the bin 10. In a desirable construction, the metering gate 48 is defined as a vertical discharge gap between the front end of the bin bottom wall 24 and the lower edge of a generally vertically extending retainer wall 49 at the front of the bin 10 under an upwardly and rearwardly extending roof extension 50 from the upper end of the front wall 32 and terminating at the front ends of the upper edges of the side walls 19. The roof wall or panel extension 50 cooperates with parallel forward extension panels 51 from the side walls 19 to enclose the front extension of the bin 10 over the conveyor 18. The lower edge of the panel 49 is located at a height above the conveyor 18 sufficient to define the maximum gate gap 48 that may be anticipated as desirable for the fuel material to be metered. In order to accomodate different grades or different volumes of material or different rates of feed, some of which will require a smaller gate gap, the gate 48 may be suitably adjusted by means of a vertically adjustable gap aperture controlling plate 52, mounted on the lower end of the panel 49. The metering gate 48 assures uniform flow of fuel material at the desired feed rate metered from the bin by operation of the conveyor 18.

In order to break up agglomerations of the bulk primary shredded, and generally damp, discrete waste fuel material and prevent any tendency to accumulate and pack and possibly jam or bridge over the conveyor 18, especially in the forward relatively confined area between the side panels 51 and the forward panel 49, a third stage of metering may be effected by suitable metering and anti-jam means such as the agitator device 53 (FIG. 3) conveniently comprising a flexible endless conveyor type of structure such as chains and/or a belt carrying cleats 54. In a preferred construction the device 53 is mounted to operate in a diagonal plane tilted about 20° to 30° from the vertical and extending from adjacently above the inner side of the gate 48 and in overlying relation to the mass of fuel material in the bin, upwardly and inwardly to adjacent juncture of the upper ends of the side wall panels 51 with the side walls 19. At its lower reach the endless device 53 is trained over pulley means 55 rotatably mounted by axle means 56 supported between the side wall panels 51. The lower pulley 55 and axle 56 may be adjusted up or down by suitable swinging adjustment of the device 53, as indicated by directional arrow 53*a*, so as to vary the gap between the lower end of the device 53 and the metering conveyor 18 whereby to help achieve desired metered flow rate of fuel material. At its upper reach, the agitator metering device 53 is trained over pulley means 57 rotatably mounted on axle means 58 carried on and between the uppermost portions of the side wall panels 51. Means for actuating the belt of the device 53 may comprise a drive motor 59 suitably coupled by means of a driving transmission 60 with the upper pulley means 57. In operation, the flexible endless device 53 is driven, as indicated by directional arrow 53*b*, with its upwardly traveling run at the inner side, so that the cleats 54 will act to drive the discrete material tending to compact theretoward in a generally upwardly and rearwardly flowing direction toward the upper and wider portion of the bin 10 where the material is less compact. Not only does this action of the device 53 level the flow of material toward the gate 48, but also maintains substantially uniform volume of the material flowing into the gate. It will be noted that the cleats 54 are in the form of flanges projecting from the plane of the endless device 53 and in the inner fuel material overlying run of the device extend generally downwardly and inwardly, so that the cleats in their active engagement with the material are self-cleaning and substantially resist clinging of material thereto since the rather steep downward angle of the cleats causes material engaged thereby to drop away as the material is carried upwardly and inwardly and freed from bunching up at the slot of the metering gate 48. Even greater self-cleaning efficiency can be attained by having the cleats angled about 5° to 10° opposite to the direction of travel of the endless device 53.

An important function of the transverse conveyor 25 is to receive from the bin 10 and effect substantially uniform and smooth, i.e. even, uninterrupted, flow of the metered material toward means for further preparation of the fuel material for delivery to combustion means. For most fuel usage situations, the transverse conveyor 25 comprises means for advancing the metered fuel in a wide stream of substantially uniform depth, such as a plurality, herein a pair of parallel helical screw conveyor members 61 (FIGS. 2 and 3) which may be similar to the helical screw conveyor members 23. The screw conveyor members 61 extend in side-by-side parallelism along the bottom of a generally trough-shaped channel 62 from under the gate 48 (FIGS. 3 and 4) and in adjacently spaced relation to one another and to a substantially flat bottom wall 63 of substantial width. Unison rotation of the conveyor screws 61 is effected by means of shafts 64 suitably journaled on opposite closed ends of the conveyor trough 62. Means rotatively driving the conveyor screws 61 comprise a suitable motor 65 FIG. 1) operating through transmission means including a gear box 67 and endless chain or belt driving coupling 68 drivingly connected with one of the shafts 64 and transmitted from that shaft to the other shaft through an endless flexible drive 69. Driving of the delivery metering conveyor screws 61 is coordinated with operation of the metering conveyor screws 23 to attain uniform delivery of the metered fuel material to further preparation means comprising a secondary shredder 70.

A function of the twin conveyor screws 61 is to attain a substantially uniform depth stream of the fuel material advanced thereby across the entire width of the conveyor 25.

In order to attain optimum results in the particular combustion means to which the fuel is to be ultimately delivered, the particle size of the material should be reasonably related to the type of burning or firing required in the process being fueled. For example, where a boiler has a stoker fuel feed, the fuel particle size may be on the order of about 2 inches (5 cm) and smaller. For air-suspension combustion purposes, as in cement kilns and many utility boilers, the particle size should be about ½ inch (12mm) and smaller. Even though the material metered from the bin 10 is supplied in primary, i.e. coarse, shredded form, the shredding usually will have been fairly rough and general, with a particle size generally in the range of about 5 to 10 inches (7.5 to 15 cm) and less, sufficient to facilitate classification. Further, during handling compacting, storage and transporting by means of compactor containers the primary shredded fuel material tends to be bounced, compacted, compressed, stuck together by moisture or other foreign materials, and because of its fibrous and irregular condition the fuel material tends to become agglomerated and compacted into lumps, clumps, etc., as it is handled enroute to the location of the final conditioning of the material for combustion.

To achieve the most rapid ignition and most effective combustion of fuels fed by air suspension means into large combustion chambers, it is highly important to break up any compactions and to reduce each particle of fuel material to be burned to its smallest possible size so that the maximum area of each particle will be exposed to the heat, oxygen and combustion conditions in the combustion zone. For instance, in large utility boilers fired with pulverized coal, the coal particle are pulverized down to a fineness of 100 to 200 microns, and finer. Therefore, it is usually desirable or even necessary to further mill or shred the primary shredded fuel material before introduction into the designated combustion zone. To this end, means are provided at the delivery end of the conveyor 25 to provide final fuel sizing control, herein comprising the secondary shredder 70 (FIGS. 2 and 4) into which the material drops from the conveyor 25 as for example through a horizontally elongated inlet port 71. To facilitate this, the delivery end of the conveyor trough 62 is suitably elevated and of substantially the same width as the length of the inlet port 71. Driving of the shredder 70 is effected by means of a motor 72.

For air-suspension firing of the lighter combustible fraction, the reshredded material is suitably conducted from the shredder 70 to the combustion means in a manner to enhance aeration and combustion exposure of the fuel particles in the combustion zone. For this purpose, the reshredded material is adapted to be conducted in airborne, suspended condition, non-stop from the shredder 70 and at substantial velocity through means comprising a vortex fan blower 73 driven by a motor 74, aerating and propelling the reshredded fuel material in substantially separated discrete condition, with substantial avoidance of wadding, packing, or lumping, through a duct 75 to combustion means 77 (FIG. 1). Thereby, the reshredded fuel reaches the combustion zone of the combustion means 77 in a highly combustible state, with maximum exposure of the individual fuel particles to the burning process, accelerating burning and assuring maximum possible combustion. Each individual particle having just passed through the secondary shredder 70 and having been subjected to the tearing action of the shredder, is at that point in its most fuzzed, fluffy, and light state as well as being substantially free and clear of any other particle. Thus, by providing for air conveying of the reshredded particles directly from the secondary shredder 70 into the combustion area of the combustion zone of the combustion means 77 without any intermediate storage or metering and with a minimum handling in the duct 75, each particle reaches the combustion zone in the most rapidly ignitible, highly combustible condition attainable for particles of this kind of fuel material.

Delivery of the reshredded fuel to the combustion means or unit 77, e.g. industrial or utility boiler or cement kiln, may be directly into its combustion zone as primary fuel or as secondary or supplemental fuel to save scarce resource fossil fuels, i.e. gas, oil, coal. If practicable the reshredded fuel may be delivered through the means for feeding the conventional fuel to the combustion means. Where, for example, the unit 77 is fed pulverized coal as through a suitable delivery conduit 78 (FIGS. 1 and 7), a delivery duct branch **75*b* may insufflate directly into the conduit 78**, the reshredded fuel commingling with or replacing the pulverized coal.

For stoker-firing of the heavier combustion fraction, the reshredded material may be conveyed by air or by mechanical conveyor means from the shredder 70 to the combustion means. Where one class of waste fuel only is being fired, this class combining both the light and heavy fuel fractions contained in municipal waste, it is desirable and possible in the present fuel processing system to convey the fuel from the shredder to the combustion means by an auger conveyor means, which will tend to somewhat wad the light fraction of the fuel mix, improve its injectability with the combustion means, and its retention time on the grate of the combustion means.

For some purposes it may be desirable to concentrate the shredded fuel volume or change the volume or velocity of delivery air before feeding into the combustion unit 77. Therefore, a delivery duct branch **75*c* may deliver the fuel into a suitable cyclone hopper 79 delivering directly to the combustion zone of the unit 77 or into the supply conduit 78 by way of a delivery duct 80 which may be equipped with fuel feed control means such as a blower fan 81, for insufflation through a nozzle 82 into the fuel delivery conduit 78, as shown in full line in FIG. 7. On the other hand, the duct 80 may insufflate through the side of the duct 78 as shown in dash outline. If preferred, the duct 80 may feed directly into the combustion zone as indicated in dot-dash outline in FIG. 7**.

In order further to improve combustibility of the shredded fuel material, it is desirably preheated. Some preheating of the reshredded material may occur as a result of heat generated in the shredder 70. Additional positive preheating of the reshredded material may conveniently be effected by recycling or shunting waste heat from the combustion means 77 to the reshredded material, e.g., hot combustion gases may be shunted from a flue 83 leading from the combustion means 77 to a stack 84. The shunted flue gases may pass through a heat exchanger 85 to avoid overheating the shredded material, and then be conducted by way of a conduit 87 (FIGS. 1 and 2) to the vicinity of the shredder 70 where part of the preheating gases may be delivered by way of a branch duct 88 to the material in the shredder below the shredder screen. Another part of the preheating gases may be delivered by a branch duct 89 to the top of the shredder 70 into or adjacent to the inlet port 71. Of course, if preferred or necessary, other preheating means may be employed such as electric, infra-red or other heat source. As a result, the reshredded fuel material and the fuel conveying air are thoroughly preheated for delivery into the combustion zone of the combustion means 77, not only enhancing combustibility of the fuel material but also enhancing efficiency of the combustion means.

If preferred, instead of the metering conveyor 18 comprising an array of screw conveyor devices, as in the form of FIGS. 1–5, a bin bottom metering conveyor 18″ (FIGS. 8 and 10) may comprise an endless flexible conveyor device such as a rubberized belt-type of endless flexible conveyor, or a number of such belts positioned side-by-side and moving simultaneously toward the gate 48, or a steel apron-type of endless conveyor, or horizontally moving drag chain or chain drag-flight conveyor means 90. In other respects the bin 10 may comprise substantially the same construction as in FIGS. 1–5, as indicated by common reference numerals. In a preferred form, the conveyor means 90 may comprise a plurality of endless chains connected together in transversely spaced pairs of longitudinally spaced transverse drag bars 91 which are dragged by the chains along the floor surface 27 of the bin bottom 24. Means comprising drag flights, cleats or wing link attachments 92 may be provided on the bars 91 to project upwardly relative to the bottom 24 to assist in metered propulsion of the fuel material from the bin. For efficiently moving the shredded waste material at the bin bottom, a staggered orientation of the drag flights 92, as shown, is advantageous. At the discharge end of the bin the conveyor chains 90 are trained over respective idler sprockets 93 carried by a shaft 94 suitably journaled on the frame 11. At the rear of the bin, the conveyor chains 90 are trained over respective idler sprockets 93 carried by a shaft 94 suitably journaled on the frame 11. At the rear of the bin, the conveyor chains 90 are trained over suitable sprockets 95 carried by a driven shaft 97 also suitably journaled on the frame 11. Driving of the shaft 97 may be effected by means comprising a motor 33' acting through a variable speed gear drive mechanism 35' to drive a transmission 37' suitably coupled with one end of the shaft 97.

From the discharge end of the bin 10, the conveyor 18'' effects metered flow of material through the metering gate 48 onto a subjacent transverse delivery conveyor 25' which may be similar to the conveyor 25 of FIGS. 1–4, but may as shown comprise a two-part conveyor system including a vibratory or shaker-type receiving conveyor section 98 and an endless flexible conveyor section such as an endless belt 99. In a desirable form, the shaker conveyor section 98 is of a suitable length, such as at least 12 to 16 feet (3.6 to 4.8 m) and suitable width to receive the material in metered volume from the bin 10 and vibrationally spread it over the width and length of the conveyor section 98 in a substantially smooth, uniform thickness layer for advance onto the endless conveyor section 99. Reciprocating, longitudinal vibratory motion of the conveyor section 98 may be effected by suitable power means 100 coupled thereto and suitably mounted on horizontal underlying frame bar means 101 which may also carry suitable vibration controlling means 102 connected to the bottom of the conveyor section 98 and adjustable as to stroke so as to vary the material delivery rate.

From the conveyor section 98 the fuel material is delivered in a substantially smooth, uniform layer to the endless belt 99 which is controlled to travel in its upper delivery run at a speed which will carry the layer of material substantially uniformly from the conveyor section 98 to the shredder 70. In its delivery run, the endless belt 99 is suitably supported on structure 103 which may, as shown in FIG. 9, extend obliquely upwardly from the delivery end of the conveyor section 98 to the top of the shredder 70. At its upper delivery end which is of substantially the same width as the length of the inlet port 71 of the reshredder 70 and in delivery registration with the inlet port 71, the belt 99 is trained over a suitable idler pulley having its shaft 104 suitably journaled in bearing means 105. At its receiving end under the discharge end of the section 98, the belt 99 is trained over a pulley 107 having its shaft 108 suitably journaled in the framework which also supports the conveyor section 98. Suitable means for driving the belt 99 may comprise a motor 65' (FIG. 8) operating through a variable speed gear device 67' to drive a transmission 68' drivingly coupled with the pulley shaft 104. Through this arrangement, the fuel material is delivered by the delivery end of the belt 99 to the shredder 70 in a stream which is substantially as wide as the width of the mouth opening or inlet port 71 and of substantially uniform depth permitting the shredder to operate at its highest eficiency and with minimum stress and wear. For example, in a shredder twelve hammers wide, no hammer will be overloaded because the outermost hammers will receive the same metered quantity of material as the inner hammers in the machine. This also improves the quantitative uniformity of pickup of the shredded material from under the shredder screens by the airflow induced by the blower 73 and assures uniformity of delivery to the combustion device.

Although in FIGS. 8, 9 and 10 the shaker conveyor 98 is located to receive material from the metering conveyor 18'' and feed it onto the endless flexible conveyor section 99 which transports the material to and feeds it into the shredder 70, a reverse arrangement may, if preferred, be employed. In such reverse arrangement, the endless flexible conveyor 99 may receive the metered material directly from the metering conveyor 18'', and deliver it to the shaker conveyor 98 located to feed the material in a uniform layer directly into the shredder 70. The same general result will thus be obtained, namely, to deliver the material uniformly to all of the hammers in the shredder.

Figure 12:
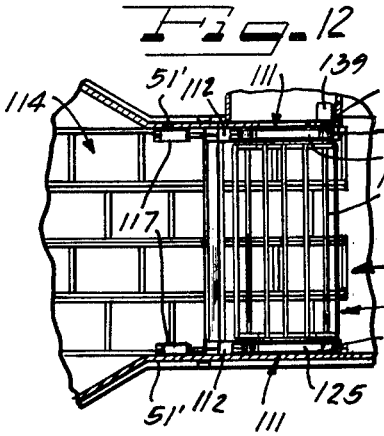
FIG. 12 is a fragmentary plan view showing the device of FIG. 11.

On reference to FIGS. 11–14, a novel agitator, metering, anti-jam device 53' is constructed and arranged for not only efficient pivotal adjustment but also up and down adjustment in addition to the pivotal adjustment. Accordingly, the device 53' is mounted in the discharge end of the bin 10' inwardly adjacent to the metering gate 52' which is adapted to be adjusted vertically as by means of a pneumatic or hydraulic actuator 110 to control the width of the gap of the metering gate 48'. In a desirable construction, the device 53' comprises a generally rectangular rigid frame 111 having longitudinal opposite side walls 112 having their lower ends pivotally mounted on bearings 113 carried in sixth position on the horizontal portions of the frame 11' at each side of the trough bottom of the bin 10' in which a metering conveyor 114, shown as similar to the conveyor 118'', operates to advance the discrete fuel material toward the gate 48'. From the pivot bearings 113, the frame 111 extends upwardly and rearwardly to adjacent the top of the bin 10' which may be closed by a roof 115 extending rearwardly from front wall 50'. The frame 111 is supported in its upward and rearward oblique position by means of pneumatic or hydraulic actuators 117, one of which is located at each side of the bin (FIG. 12). Although the actuators 117 are shown as pivotally secured to side walls 51' of the bin in such position as to enable piston rods 118 of the actuators to be connected pivotally to upper portions of the side bars 112 and permit the actuators to adjust the oblique angle of the device 53' for optimum results in the operation of the system, the actuators may operate overhead and be mounted on or adjacent to the roof 115.

Although the device 53' as shown in full outline is at about a 30° angle to the vertical position of the gate 52, under some conditions a 20° angle may be better. An about 37° angle of the device is shown in dash outline, and about a 42° angle of the device is shown in dot-dash outline, by way of example of the range of adjustment which may be desirable to meet various conditions of the fuel being handled in the bin 10', such as the state of moisture content, composition of the fuel material, and the like. The greater the tendency for the material to jam, the greater should be the angle of the device 53', and the further it should overlie the material in order to control proper metered feeding of the materials to and through the gate 48'.

Figure 3:
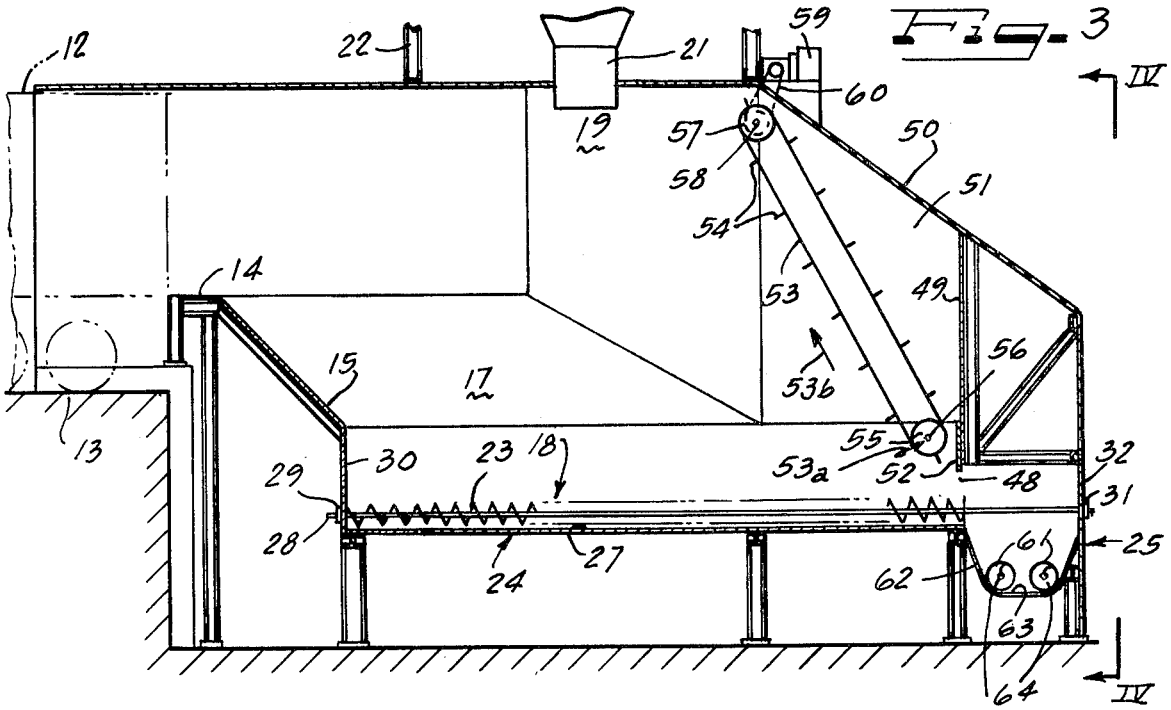
FIG. 3 is a sectional elevational view taken substantially along the line III—III of FIG. 2.
Figure 4:
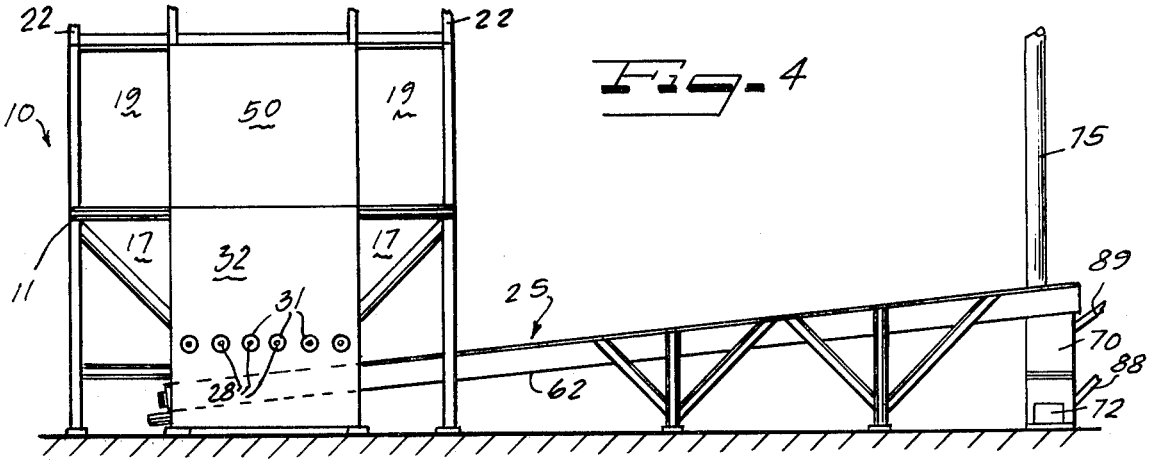
FIG. 4 is an elevational view taken substantially in the plane of line IV—IV in FIG. 3.

Similarly as in respect to the device 53 in FIG. 3, the device 53' has endless flexible conveyor-type of structure for anti-jamming action on the material advanced toward the metering gate 48'. For this purpose, endless chains 119 of generally sprocket chain type are trained over respective sprockets 120 adjacent the lower end of the frame 111 and sprockets 121 adjacent the upper end of the frame and located at each opposite side of the frame, with generally L-shape cross-section cleats 122 secured at suitable intervals in spaced parallel relation on the chains and having base flanges 123 secured to the chains and projecting in the direction of advance of the chains and cleat flanges 124 extending from the trailing edge of the base flanges 123 and away from the chains 119. In order to permit up and down adjustment, that is longitudinal adjustment relative to the frame 111, the chain and cleat assembly is mounted on carriage means comprising respective carriage bar members 125 at each opposite side of the assembly and slidably mounted on and retained by means of suitable retaining guide clips 127 on the outer faces of the frame bars 112. Mounting of the sprockets 120 on the carriage bars 125 is by means of a shaft 128 journaled on bearings 129 fixedly carried by lower end portions of the frame bars 125. Mounting of the sprockets 121 is by means of a transverse shaft 130 journaled in bearings 131 carried by upper portions of the carriage bars 125, and equipped with chain tension adjusting means 132.

Lower limit of the carriage 125 may be determined by fixed stops 133 carried by the frame bars 112 and engageable by the lower ends of the respective side bars 125 of the carriage. Up and down adjustments of the flexible agitating assembly is adapted to be effected by respective fluid actuators 134, either pneumatic or hydraulic, anchored on respective blocks 135 fixed to the respective frame bars 112, and having actuating piston rods 137 coupled to respective ears 138 secured to the outer sides of the frame bars 112. Through this arrangement, the carriage 125 is adapted to be shifted throughout a substantial range between the stops 133 and an upper position as indicated in dash outline in FIG. 11. Up-and-down shifting of the carriage 125 with respect to the frame bars 112 may, if preferred, be achieved by gear or rack-and-pinion mechanisms.

Figure 2:
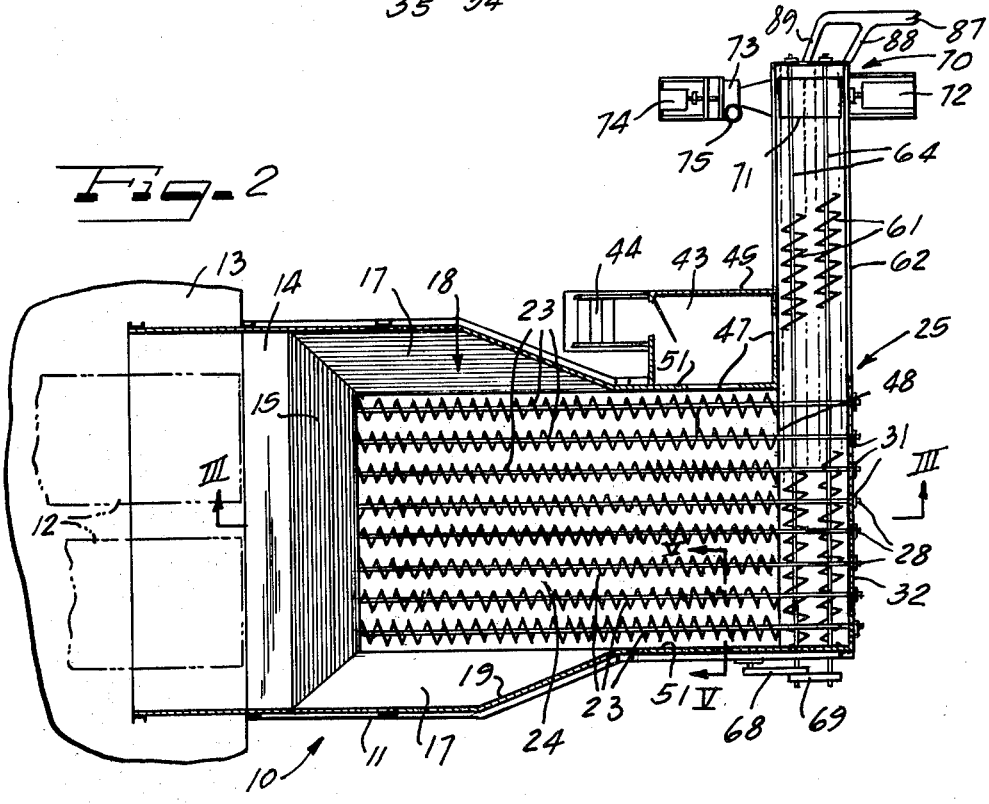
FIG. 2 is a sectional plan view taken substantially along the line II—II of FIG. 1.
Figure 13:
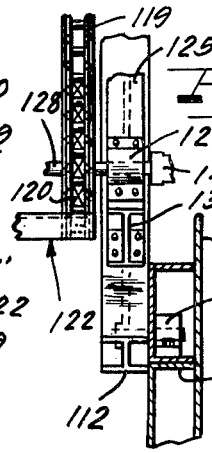
FIG. 13 is a fragmentary sectional elevational view taken substantially along the line XIII—XIII of FIG. 11.
Figure 14:
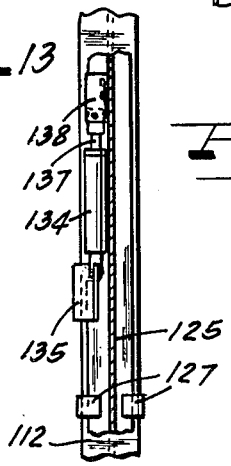
FIG. 14 is a fragmentary sectional elevational view taken substantially along the line XIV—XIV of FIG. 11.

Control and operation of the several actuators 110, 117 and 134 may be effected manually or automatically at a suitable control station, such as the control station located on the platform 43 in FIGS. 2 and 8. Likewise, control of operation of the flexible chain and cleat assembly 119, 122 may be effected by controlling operation of a drive motor 139 (FIG. 12), which may be of the variable speed type, coupled to the shaft 128 as by means of a flexible transmission shaft 140 (FIGS. 12 and 13). As the cleats 122 are driven in the direction indicated by the arrow 141 in FIG. 11, the advancing cleats will engage the fuel material mass advancing toward the front of the bin, that is, toward the gate 48' and skim off the material which is higher than at least the top of the gap at the gate 48', or as may be determined by up and down and tilted adjustments of the device 53', the skimmed material being thrown back toward the rear of the bin and away from the gate area, thereby relieving any tendency for the material to crowd, bridge or jam in the gate area and substantially contributing to smooth, uniform metering of the fuel material from the bin.

A desirable feature of the device 53' is the ability to vary the speed of operation of the chains 119. When the fuel material is light or the rate of feed through the bin 10 is slow, the chains can operate more slowly. When the fuel feed rate is fast or the fuel tends to be heavy, the operating time of the chains 119 can be speeded up. This helps additionally to assure proper operation of the anti-jam mechanism, whatever the fuel feed rate and whatever the density, moisture and other conditions of the fuel itself may be.

Although several forms of conveyor arrarangements have been disclosed both in relation to the metering conveyor means in the bin and in respect to the receiving and conveying conveyor means which transports the metered material from the bin to the secondary shredder, various permutations may be effected, depending upon particular requirements. For example, any one of the screw-type or shaker conveyor-type or endless flexible-type of the metering conveyor means may be employed as required or as desired in association with either the screw-type or the combination shaker section and endless flexible conveyor section receiving and conveying conveyor. Whatever permutation of conveyor structures may be selected, all parts of the system will be integrated in operation with one another and with the associated combustion means for smooth, dependable, quantitatively uniform flow and delivery of the reshredded refuse-derived fuel conformable to demand at the combustion means, even where the demand may fluctuate widely.

In addition to any manual controls for the system, automatic fuel demand control to assure required operating BTU requirements in the combustion device 77 (FIG. 1) may be attained by suitable means identified as a control box 141 (FIG. 8) which may be located in the control cabin area on the platform 43, or in the control room of the combustion means 77. A suitable control connection 142 may be effected between the combustion device 77 and the control box 141. A control connection between the control box 143 and the motor 33' in FIG. 8 or the motor 33 in FIG. 1, provides for automatically controlling the speed of operation of the bin bottom metering conveyor, and thus the volume of fuel material to be supplied to the combustion device 77.

In addition, because of variable density and feeding conditions that may be encountered in the fuel material, it is desirable to monitor the weight of the fuel being supplied and effect suitable adjustments in the rate of fuel supply flow in operation. For this purpose, a weight sensitive scale 144 (FIGS. 8 and 9) may be located operatively under the load-carrying run of the conveyor belt 99 to measure and record the rate of feed and total volume of the fuel. A signal line may be used to connect the scale 144 with the control box 141, whereby the speed of the bin bottom metering conveyor is controlled to maintain a properly balanced relation between the fuel feed rate and the combustion device fuel demand, to achieve the desire fuel volume and uniformity of feed rate.

The economic and social value of the present invention will be appreciated when considering the huge volume of municipal waste that must be disposed of, especially by large municipalities. Incineration and land fill or ocean dumping are economically burdensome and ecologically unsatisfactory expedients. Each ton of combustible material waste can produce about 14 million BTU's, whereas a barrel of fuel oil will provide about 6 million BTU's. Therefore each ton of fuel recovered from municipal waste has the potential of supplying BTU's equivalent to about 2.2 barrels of oil. Tapping of the vast tonage of combustibles in municipal waste can result in significant reduction in consumption of fuel oil as well as other fossil fuels, especially in large industrial and utility combustion facilities.

However, one of the major problems in utilization of the waste derived fuel is that waste collection centers are generally concentrated as close as practicable to the vicinity of the waste source, i.e. within or closely adjacent to the affected muncipalities. On the other hand the combustion facilities, i.e. boilers, furnaces, which can utilize the recovered fuel material are generally located at some distance and often many miles from the waste collection facility in which separation of combustibles from the waste is most feasibly accomplished. The present invention enables taking advantage of such feasibility, because shredding and classification, i.e. separation of the combustible from non-combustible fractions can be effected at the most convenient location irrespective of the location of the combustion facilities in which the combustible fuel material is to be consumed.

At the recovery site the coarsely shredded recovered fuel material may be accumulated in large storage bins or it may be received directly in large compactor containers, or either of these expedients may be alternately employed depending on prevailing conditions. In any event, it is a characteristic of fuel material derived from shredded municipal rubbage or waste that it generally contains moisture and therefore has a tendency to pack and agglomerate into clumps when packed into a transportation container or held in bulk storage for any length of time even for a few hours. In fact, it is generally necessary to bulk store substantial volume of the recovered waste fuel material because collection of municipal waste may be effected in only one or two shifts a day, and the solid waste recovery and recycling plant at which the collected municipal waste material is shredded and classified will generally operate only five or six days a week, but the combustion facilities generally operate continuously.

From the recovery and recycling plant the coarsely shredded recovered fuel material is adapted to be transported in large compactor containers which may have a capacity as high as 18 tons in each load. An excellent container for this purpose is disclosed in U.S. Pat. No. 3,720,328. Inasmuch as the coarsely shredded fuel may have to be transported many miles, 50 miles being not unusual, from the recycling site to the combustion site, there is virtually certain to be substantial agglomeration of the fuel material. If the material were shredded to adequate small size for efficient combustion, it would be even more compactly agglomerated upon arrival at the relatively distant combustion site.

By virtue of the present invention final processing of the fuel material at the combustion site is adapted to be effected in an efficient, economical manner, involving only the storage and metering bin, the delivery conveyor means, the reshredder, and the means for delivering from the reshredder to the combustion means, on a continuous demand basis even where the combustion means operates continuously 24 hours every day. Even though the coarsely shredded fuel material may be largely agglomerated as delivered to the storage and metering bin, it is at least partially broken up in the metering process, and then it is thoroughly and substantially uniformly reduced in particle size and separated into substantially individual particles in the reshredder for efficient combustibility.

It will be understood that variations and modifications may be effected without departing from the spirit and scope of the novel concepts of this invention.

We claim as our invention:

1. A shredded fuel handling, metering and preparation apparatus, comprising:

a bin for receiving bulk coarse primary shredded fuel material;

means defining a metering gate at a discharge end of said bin;

metering conveyor means for moving shredded fuel material from the bin through said gate;

delivery conveyor means for receiving the primary shredded fuel material metered through said gate and operative to form the received primary shredded material into a stream of substantial width and substantially uniform depth;

a hammer mill reshredder having a plurality of hammers which receive material to be shredded through a horizontally elongated inlet port into which the stream of primary shredded materal is delivered from the conveyor means to the hammers for efficient uniform reshredding into a preferred ultimate fuel particle size;

said delivery conveyor means comprising a transverse delivery conveyor of substantial width subjacent to said gate;

said conveyor acting on said shredded fuel material received on the conveyor to spread the material substantially uniformly across the conveyor and advancing the material along the conveyor toward the reshredder; and said delivery conveyor having a delivery end of substantially the same width as the length of said inlet port and registering with said inlet port so that the uniformly spread stream of primary shredded material is deposited into the reshredder from said delivery conveyor substantially uniformly throughout substantially the inlet port length and so that all of the hammers of the reshredder receive substantially the same metered quantity of the primary shredded material delivered through said inlet port whereby overloading of any of the hammers is avoided.

2. Apparatus according to claim 1, wherein said delivery conveyor comprises a trough having therein a plurality of screw conveyor devices in side-by-side spaced parallel relation.

3. Apparatus according to claim 1, wherein said delivery conveyor comprises a vibratory conveyor device of substantial width operative to effect said substantially uniform layer distribution of the primary shredded material received thereon into the substantially uniform stream and to advance the material toward the reshredder, and an endless flexible conveyor device cooperative with the vibratory conveyor device for advancing the substantially uniform stream of primary shredded material toward said delivery end and said inlet port of the reshredder.

4. Apparatus according to claim 1, including metering and agitator means in said bin at least in part defining said gate and comprising a cleated endless flexible member, and means for guiding said member to run from a position adjacent to said gate and generally upwardly and inwardly within the bin in generally overlying relation to the primary shredded material in the bin and at an oblique angle of about 20° to 30° to the vertical.

5. Apparatus according to claim 1, including a weight sensitive weighing scale operatively related to said delivery conveyor to measure and record the rate of feed and total volume of the primary shredded fuel material on the delivery conveyor, and means responsive to said scale for controlling operation of said metering conveyor means.

6. Apparatus according to claim 5, including combustion means having variable fuel input requirements, means for delivering reshredded fuel material from said reshredder to said combustion means and means for controlling operation of said metering conveyor means in accordance with fuel requirements of the combustion means.

7. Apparatus according to claim 1, including combustion means having variable fuel input requirements, means for delivering reshredded fuel material from said reshredder to said combustion means, and means for controlling operation of said metering conveyor means in accordance with fuel requirements of the combustion means.

8. Apparatus according to claim 1, including air-suspension firing combustion means having a combustion zone receptive of particulate fuel injected thereinto for supporting combustion; said reshredder reducing the primary shredded fuel to small fuzzed, fluffy particles; and means including a blower for aerating and advancing the fuzzed, fluffy particles from the reshredder substantially non-stop into the combustion zone and thereby maintaining efficient, free, fluffy, fuzzed and utmost combustible state of each individual particle from the point of reshredding to the combustion zone.

9. Apparatus according to claim 8, including a pulverized coal conduit for injecting pulverized coal into said combustion zone, and said means for introducing the reshredded particles into said pulverized coal conduit and thereby effecting delivery of the reshredded particles commingled with pulverized coal particles into said combustion zone.

10. Apparatus according to claim 8, including means for preheating the reshredded particles, and maintaining the particles in the preheated state to the combustion zone.

11. Apparatus according to claim 10, wherein said preheating means comprises duct means for conducting heat from the combustion means to said reshredder and including means for introducing preheating heat into the reshredder adjacent to said horizontal inlet for preheating the primary shredded material as delivered to the reshredder and also means for conducting said preheating heat into the lower part of the reshredder for further heating the reshredded particles.

12. Apparatus according to claim 1, wherein said metering conveyor means comprise a plurality of conveyor screws in spaced parallel relation, and said bin has a bottom comprising troughs of about half the depth of said conveyor screws in which the screws ae rotatably mounted.

13. Apparatus according to claim 1, wherein said metering conveyor means comprise conveyor belt structure substantially defining a movable bottom wall for the bin, said conveyor belt structure comprising a plurality of parallel sections; each of said sections having cleats extending thereacross in spaced parallel relation; said cleats being staggered with respect to the cleats of any contiguous conveyor belt section.

14. A method of handling, metering and preparation of shredded fuel, comprising:

receiving bulk coarse primary shredded fuel material in a bin;

moving the primary shredded fuel material from the bin through a metering gate at a discharge end of said bin;

receiving on delivery conveyor means subjacent to said gate the primary shredded fuel material metered through said gate and on said delivery conveyor means spreading the received primary shredded material into a stream of substantial width and substantially uniform depth and moving the material to a delivery end of the conveyor means;

delivering said stream of primary shredded material from said delivery end of the conveyor means into a horizontally elongated inlet port of a length substantially equal to the width of said stream in the top of a hammermill reshredder having a plurality of hammers which receive the material to be reshredded through said inlet port; and depositing said stream into the reshredder substantially uniformly throughout substantially the inlet port length and thereby to all of the hammers in the reshredder in substantially the same metered quantity and thereby effecting efficient uniform reshredding of the delivered primary shredded material into a preferred ultimate fuel particle size and avoiding overloading of any of the hammers.

15. A method according to claim 14, comprising vibrating the primary shredded material received on a section of the delivery conveyor means into said substantially uniform stream, and in cooperation with said section advancing the primary shredded material on an endless flexible conveyor device toward said delivery end of the conveyor means and said inlet port of the reshredder.

16. A method according to claim 14, including metering and agitating the primary shredded material adjacent to said gate by driving a cleated endless flexible member to run from a position adjacent to said gate and generally upwardly and inwardly within the bin in generally overlying relation to the primary shredded material in the bin and at an oblique angle of from about 20° to 30° to the vertical.

17. A method according to claim 16, comprising adjusting the lower end height of the endless flexible member relative to said metering conveyor means.

18. A method according to claim 16, comprising selectively increasing or decreasing the oblique angle of said endless flexible member and selectively increasing or decreasing the speed of travel of said endless flexible member to meet variable operating demands.

19. A method according to claim 14, comprising operatively relating a weight sensitive weighing scale to said delivery conveyor means and detecting the weight of the stream moving along said delivery conveyor means, and controlling the movement of the shredded fuel material from the bin through the gate in accordance with the weight detected by said scale.

20. A method according to claim 19, including conveying the reshredded fuel material to a combustion means, and further controlling movement of the shredded material from the bin through the gate in accordance with fuel requirements of the combustion means.

21. A method according to claim 14, comprising conveying the reshredded fuel material to a combustion means, and controlling movement of the primary shredded fuel material from the bin through the gate in accordance with fuel requirements of the combustion means.

22. A method according to claim 14, comprising reducing the primary shredded fuel material in the reshredder into small fuzzed, fluffy particles for air-suspension firing and aerating and advancing the reshredded fuzzed, fluffy particles from the reshredder substantially non-stop into the combustion zone of a combustion means receptive of particulate fuel injected thereinto for supporting combustion, and maintaining the free, fuzzed, fluffy and most combustible state of each individual particle from the point of reshredding to the combustion zone.

23. A method according to claim 22, including injecting pulverized coal into said combustion zone, and conducting the reshredded fuel particles into the pulverized coal and thereby effecting delivery of the reshredded particles commingled with the pulverized coal particles into said combustion zone.

24. A method according to claim 22, including preheating the reshredded particles, and maintaining the particles in preheated state to the combustion zone.

25. A method according to claim 24, comprising preheating the primary shredded fuel material on delivery into the reshredder, and further preheating the fuel material after reshredding in the reshredder.

26. A method according to claim 14, comprising reducing the course primary shredded material from a particle size of about 5 to 10 inches to a reshredded size of about ½ to 2 inches.

27. A shredded fuel handling, metering and preparation apparatus, comprising:

a bin for receiving bulk coarse primary shredded fuel material;

means defining a metering gate at a discharge end of said bin;

metering conveyor means for moving shredded fuel material from the bin through said gate;

delivery conveyor means for receiving the primary shredded fuel material metered through said gate operative to form the received primary shredded material into a stream of substantial width and substantially uniform depth;

a reshredder having a horizontally elongated inlet port into which the stream of primary shredded material is delivered from the conveyor means for efficient uniform reshredding into a preferred ultimate fuel particle size;

metering and agitator means in said bin at least in part defining said gate and comprising a cleated endless flexible member;

and means for guiding said member to run from a position adjacent to said gate and generally upwardly and inwardly within the bin in generally overlying relation to the primary shredded material in the bin and at an oblique angle of about 20° to 30° to the vertical.

28. Apparatus according to claim 27, wherein said means for guiding comprise rotary elements over which the endless flexible member runs and shafts mounting the rotary elements at upper and lower ends of the metering and agitator means, the lower of said shafts being adjustable to adjust the lower end height of the endless flexible member relative to said metering conveyor means.

29. Apparatus according to claim 27, including actuator means for selectively increasing or decreasing the oblique angle of said metering and agitator means relative to said 30° oblique angle.

30. Apparatus according to claim 27, wherein said metering and agitator means comprise an oblique frame, means pivotally mounting the lower end of said frame, and adjustable means connected to the upper end of the frame and operable to adjust the oblique angle of the frame.

31. Apparatus according to claim 30, including a carriage supported by said frame, said carriage mounting said means for guiding said member.

32. Apparatus according to claim 31, wherein said endless flexible member comprises a pair of chains in coextensive spaced parallel relation having cleats mounted thereon and extending between the chains, sprockets carried by the upper and lower ends of said carriage and mounting said chains, and means for driving the sprockets at one end of said carriage to effect running of the endless flexible member.

33. Apparatus according to claim 31, including means for effecting longitudinal adjustments of the carriage relative to said frame whereby to adjust the spacing of the lower end of the cleated endless flexible member relative to said metering conveyor means.

34. A shredded fuel handling, metering and preparation apparatus, comprising:

a bin for receiving bulk coarse primary shredded fuel material;

means defining a metering gate at a discharge end of said bin;

metering conveyor means for moving shredded fuel material from the bin through said gate;

delivery conveyor means for receiving the primary shredded fuel material metered through said gate and operative to form the received primary shredded material into a stream of substantial width and substantially uniform depth;

a reshredder having a horizontally elongated inlet port into which the stream of primary shredded material is delivered from the conveyor means for efficient uniform reshredding into a preferred ultimate fuel particle size; and a weight sensitive weighing scale operatively related to said delivery conveyor to measure and record the rate of feed and total volume of the primary shredded fuel material on the delivery conveyor, and means responsive to said scale for controlling operation of said metering conveyor means.

35. A shredded fuel handling, metering and preparation apparatus, comprising:

a bin for receiving bulk coarse primary shredded fuel material;

means defining a metering gate at a discharge end of said bin;

metering conveyor means for moving shredded fuel material from the bin through said gate;

delivery conveyor means for receiving the primary shredded fuel material metered through said gate and operative to form the received primary shredded material into a stream of substantial width and substantially uniform depth;

a reshredder having a horizontally elongated inlet port into which the stream of primary shredded material is delivered from the conveyor means for efficient uniform reshredding into a preferred ultimate fuel particle size;

air-suspension firing combustion means having a combustion zone receptive of particulate fuel injected thereinto for supporting combustion;

said reshredder reducing the primary shredded fuel to small fuzzed, fluffy particles;

means including a blower for aerating and advancing the fuzzed, fluffy particles from the reshredder substantially non-stop into the combustion zone and thereby maintaining efficient free, fluffy, fuzzed and utmost combustible state of each individual particle from the point of reshredding to the combustion zone;

a pulverized coal conduit for injecting pulverized coal into said combustion zone;

and said means introducing the reshredded particles into said pulverized coal conduit and thereby effecting delivery of the reshredded particles commingled with pulverized coal particles into said combustion zone.

36. Apparatus according to claim 35, including means for preheating the reshredded particles so as to maintain the particles in the preheated state to introduction of the reshredded particles into the pulverized coal conduit.

37. A method of handling, metering and preparation of shredded fuel, comprising:

receiving bulk coarse primary shredded fuel material in a bin;

moving the primary shredded fuel material from the bin through a metering gate at a discharge end of said bin;

receiving on delivery conveyor means the primary shredded fuel material metered through said gate and thereon forming the received primary shredded material into a stream of substantial width and substantially uniform depth;

delivering the stream of primary shredded material from the conveyor means into a horizontally elongated inlet port in the top of a reshredder;

in the reshredder effecting efficient uniform reshredding of the delivered primary shredded material into a preferred ultimate fuel particle size; and metering and agitating the primary shredded material adjacent to said gate by driving a cleated endless flexible member to run from a position adjacent to said gate and generally upwardly and inwardly within the bin in generally overlying relation to the primary shredded material in the bin and at an oblique angle of from about 20° to 30° to the vertical.

38. A method according to claim 37, comprising adjusting the lower end height of the endless flexible member relative to said metering conveyor means, selectively increasing or decreasing the oblique angle of said endless flexible member, and selectively increasing or decreasing the speed of travel of said endless flexible member to meet variable operating demands.

39. A method of handling, metering and preparation of shredded fuel, comprising:

receiving bulk coarse primary shredded fuel material in a bin;

moving the primary shredded fuel material from the bin through a metering gate at a discharge end of said bin;

receiving on delivery conveyor means the primary shredded fuel material metered through said gate and thereon forming the received primary shredded material into a stream of substantial width and substantially uniform depth;

delivering the stream of primary shredded material from the conveyor means into a horizontally elongated inlet port in the top of a reshredder;

in the reshredder effecting efficient uniform reshredding of the delivered primary shredded material into a preferred ultimate fuel particle size;

reducing the primary shredded fuel material in the reshredder into small fuzzed, fluffy, particles for air-suspension firing and aerating and advancing the reshredded fuzzed fluffy particles from the reshredder substantially non-stop into the combustion zone of a combustion means receptive of particulate fuel injected thereinto for supporting combustion;

maintaining the free, fuzzed, fluffy and most combustible state of each individual particle from the point of reshredding to the combustion zone;

injecting pulverized coal into said combustion zone;

and conducting the reshredded fuel particles into the pulverized coal and thereby effecting delivery of the reshredded particles commingled with the pulverized coal particles into said combustion zone.

* * * * *